US010961789B2

(12) United States Patent
Makelki

(10) Patent No.: US 10,961,789 B2
(45) Date of Patent: Mar. 30, 2021

(54) CENTRALIZER

(71) Applicant: Plainsman Mfg. Inc., Edmonton (CA)

(72) Inventor: Thomas Makelki, Edmonton (CA)

(73) Assignee: Plainsman Mfg. Inc., Edmonton (CA)

( * ) Notice: Subject to any disclaimer, the term of this patent is extended or adjusted under 35 U.S.C. 154(b) by 0 days.

(21) Appl. No.: 16/093,563

(22) PCT Filed: Apr. 12, 2017

(86) PCT No.: PCT/CA2017/050454
§ 371 (c)(1),
(2) Date: Oct. 12, 2018

(87) PCT Pub. No.: WO2017/177330
PCT Pub. Date: Oct. 19, 2017

(65) Prior Publication Data

US 2019/0071936 A1 Mar. 7, 2019

Related U.S. Application Data

(60) Provisional application No. 62/321,635, filed on Apr. 12, 2016.

(51) Int. Cl.

| | |
|---|---|
| ***E21B 17/10*** | (2006.01) |
| ***E21B 17/042*** | (2006.01) |
| ***E21B 19/24*** | (2006.01) |
| ***E21B 10/30*** | (2006.01) |

(52) U.S. Cl.
CPC ..... *E21B 17/1042* (2013.01); *E21B 17/1057* (2013.01)

(58) Field of Classification Search
CPC .... E21B 17/042; E21B 17/1057; E21B 17/10; E21B 17/1078; E21B 19/24; E21B 10/30
See application file for complete search history.

(56) References Cited

U.S. PATENT DOCUMENTS

2012/0193089 A1* 8/2012 Makelki ..... E21B 17/1071 166/241.1

FOREIGN PATENT DOCUMENTS

CN 2903342 Y * 5/2007

OTHER PUBLICATIONS

"Interference fit," Wikipedia, The Free Encyclopedia, Sep. 22, 2019, <https://en.wikipedia.org/wiki/Interferencefit> 4 pages.

* cited by examiner

*Primary Examiner* — Giovanna Wright
*Assistant Examiner* — Manuel C Portocarrero
(74) *Attorney, Agent, or Firm* — Christensen O'Connor Johnson Kindness, PLLC

(57) ABSTRACT

A simple centralizer, comprising a mandrel extending between box couplings, a rotor receiving surface between the box couplings, a shoulder on the mandrel defining a first end of the rotor receiving surface; and a collar receiving surface on a second end of the rotor receiving surface. The collar receiving surface may be unthreaded. In use, a collar is press fit on to the collar receiving surface.

13 Claims, 4 Drawing Sheets

CENTRALIZER

TECHNICAL FIELD

Centralizers for downhole strings.

BACKGROUND

Centralizers are used to prevent downhole strings contacting interior well surfaces and thus reduce wear on the strings. Lower cost centralizers are desirable.

SUMMARY

There is disclosed a simple centralizer, comprising a mandrel extending between box couplings, a rotor receiving surface between the box couplings, a shoulder on the mandrel defining a first end of the rotor receiving surface; and a collar receiving surface on a second end of the rotor receiving surface. The collar receiving surface may be unthreaded. In use, a collar is press fit on to the collar receiving surface, and a rotor is provided on the rotor receiving surface.

BRIEF DESCRIPTION OF THE FIGURES

Embodiments will now be described with reference to the figures, in which like reference characters denote like elements, by way of example, and in which.

DETAILED DESCRIPTION

Figure 1:
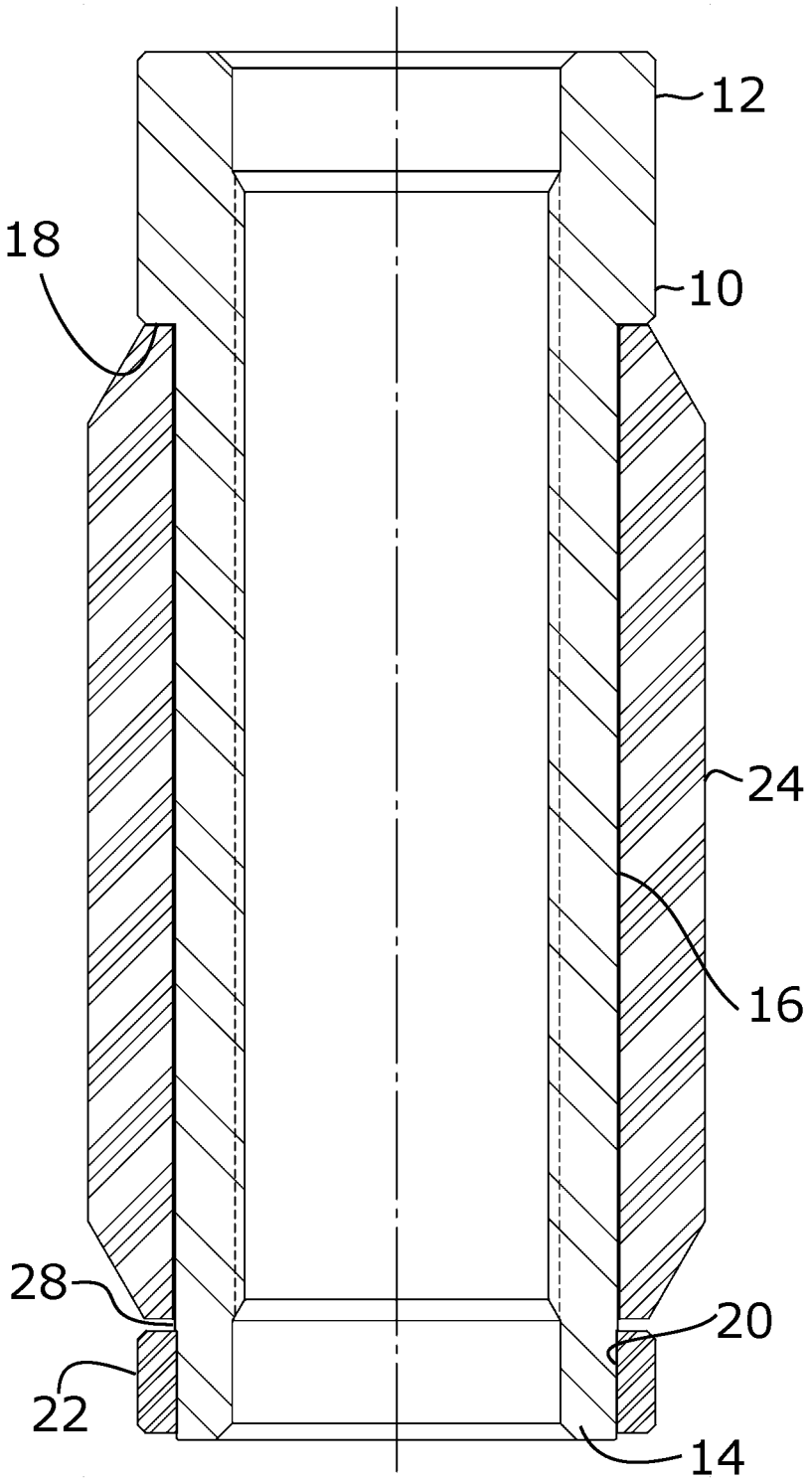
FIG. 1 shows section through a centralizer.
Figure 2:
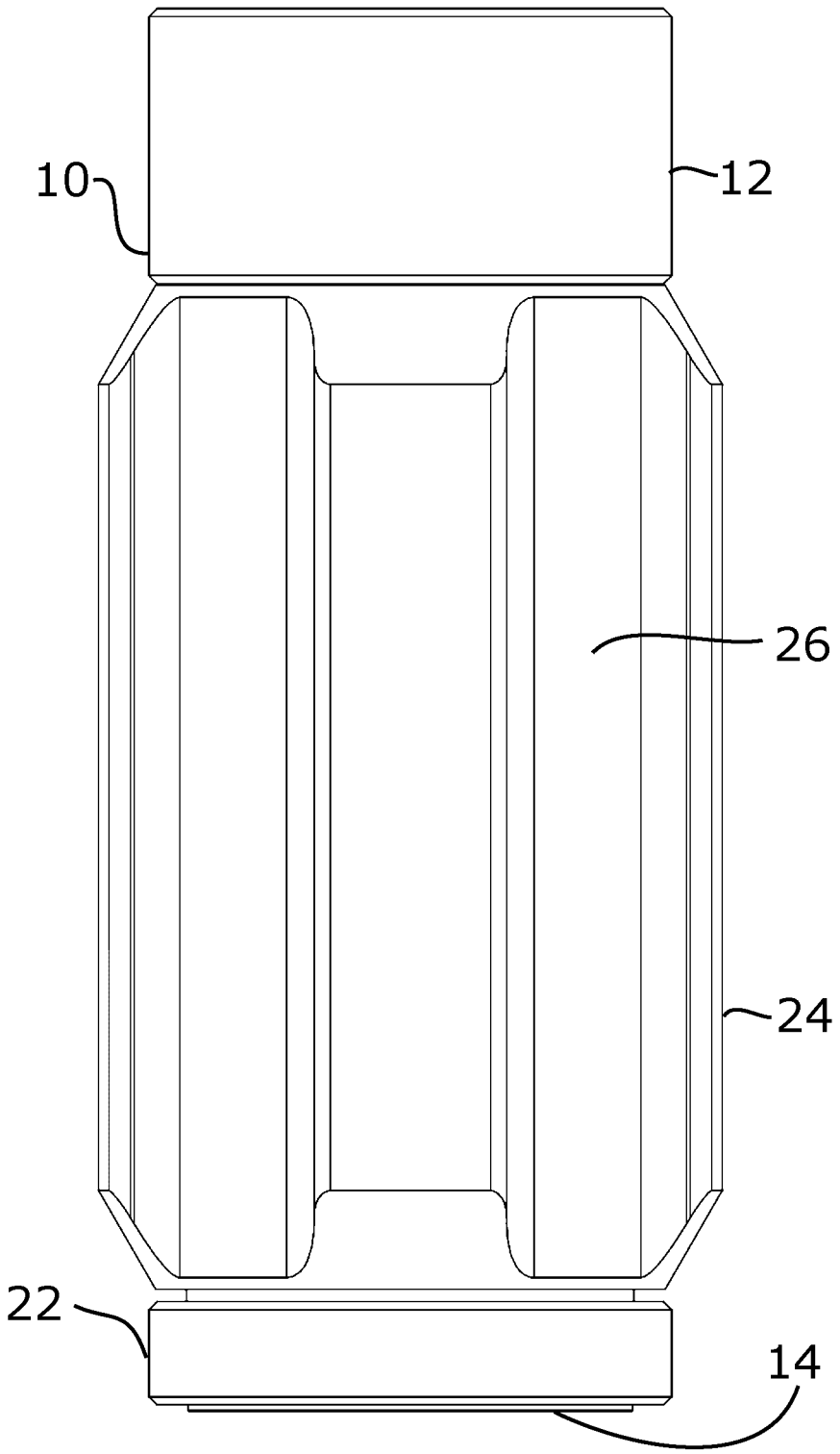
FIG. 2 shows a side view of the centralizer of FIG. 1.

Immaterial modifications may be made to the embodiments described here without departing from what is covered by the claims. In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

Referring to the figures, there is shown a centralizer formed of a mandrel 10 that extends between couplings 12, 14, both or either of which may be box couplings or pin couplings, but preferably box couplings. A rotor receiving surface 16 is provided between the box couplings 12, 14. A shoulder 18 on the mandrel defines a first end of the rotor receiving surface 16. A collar receiving surface 20 is at a second end of the rotor receiving surface 16. The mandrel 10 is a separate unit that may be manufactured as a single unit. In use, a collar 22 may be press fit on to the collar receiving surface 20, and a rotor 24 provided on the rotor receiving surface 16. To enhance the press fit, the collar receiving surface 20 may be smooth. The collar receiving surface 20 may have uniform outer diameter. The collar receiving surface 20 may be unthreaded. The internal diameter of the collar 22 may be very close to the outer diameter of the collar receiving surface 20 to form a press fit. A press fit is formed when pressure is required to cause the collar 22 to fit on to the collar receiving surface 20. If the internal diameter of the collar 22 is too much less than the outer diameter of the collar receiving surface 20, depending on the difference between the two diameters, the collar 22 may need to be heated and expanded to be fit on to the collar receiving surface.

Figure 3:
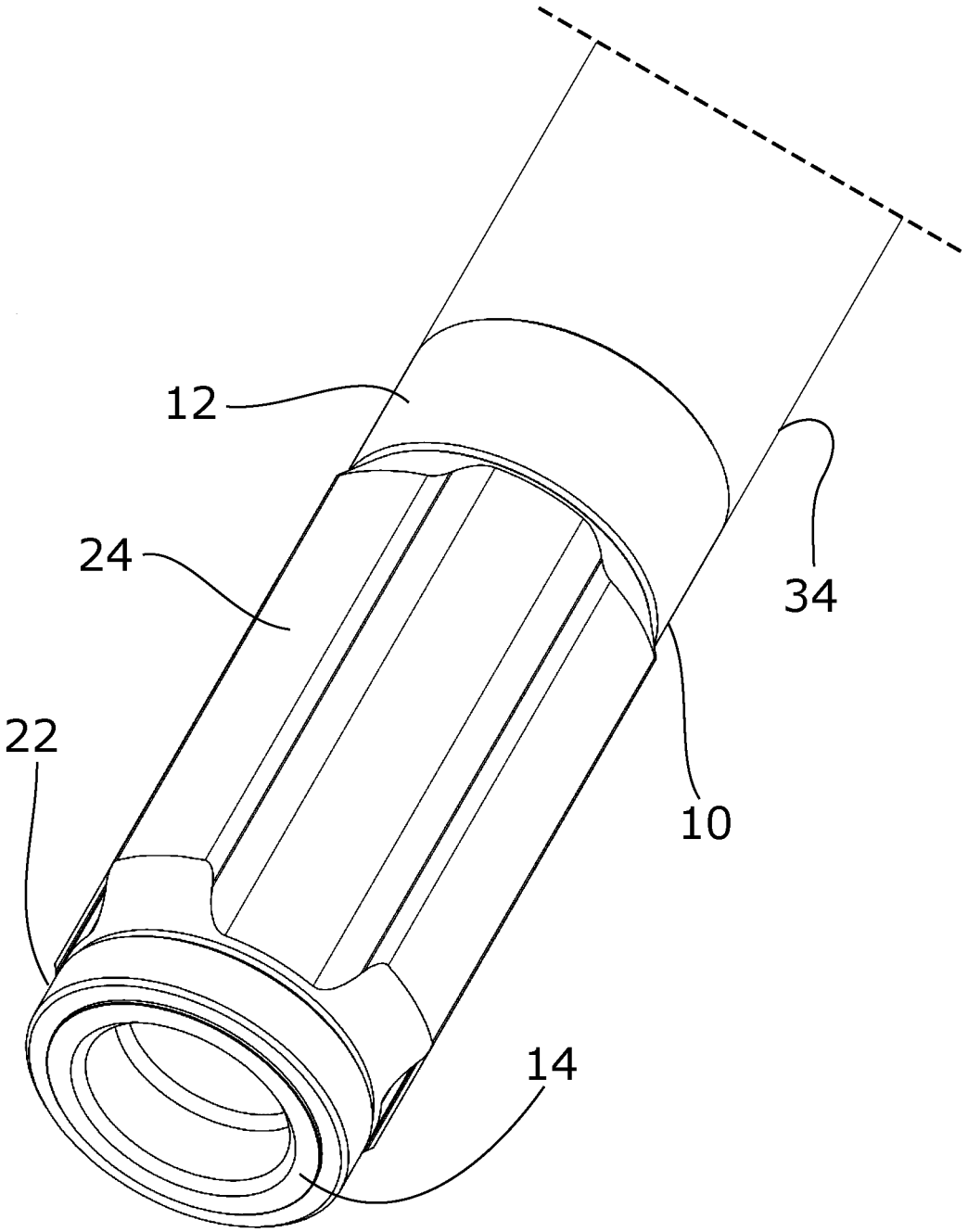
FIG. 3 is a perspective view of the centralizer of FIG. 1.
Figure 4:
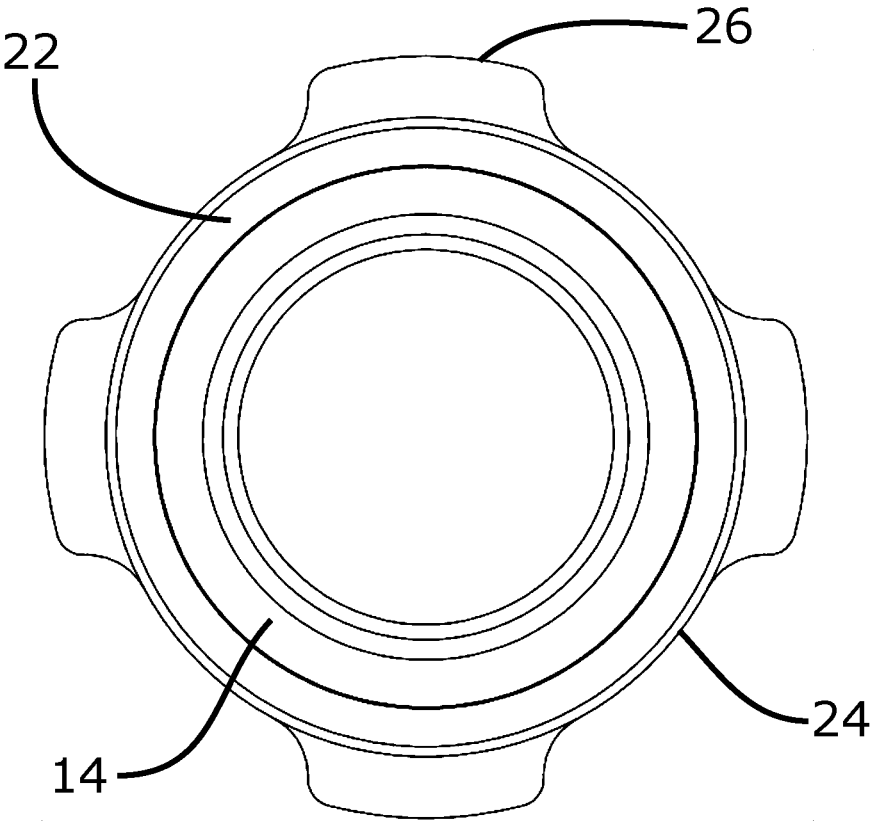
FIG. 4 is an end view of the centralizer of FIG. 1.

The rotor 24 may have various finishes or surface configurations such as vanes 26. The rotor 24 is loosely fit on the rotor receiving surface 16 for rotation on the mandrel. The collar 22 has an interior diameter closely matching the outer diameter of the collar receiving surface so that the press or interference fit holds the collar 22 on the mandrel 10 with sufficient strength to prevent loosening due to normal downhole forces on the rotor 24. The rotor receiving surface 16 may be very slightly larger than the collar receiving surface 20 with a bevel, taper or rise 28 in the mandrel surface between the surfaces 16 and 20. Thus, the collar receiving surface has an outer diameter A, the rotor receiving surface has an outer diameter B and A is less than B Box coupling 12 may be uniform in outer diameter and have a greater outer diameter than box coupling 14 in order to form shoulder 18. The centralizer rotor 24 may be a tubular sleeve formed of non-metallic soft resilient abrasion-resistant material, such as polyurethane or high temperature nylon, and fits loosely upon the cylindrical surface of the mandrel. The mandrel 10 and collar 22 may be made of any suitable material such as steel suitable for downhole use. The centralizer has particular use for rod strings, illustrated schematically at 34 in FIG. 3.

The embodiments of the invention in which an exclusive property or privilege is claimed are defined as follows:

1. A centralizer for rod strings, comprising:

a mandrel extending between a first and a second coupling, the mandrel having an axis, the first coupling having a uniform first coupling diameter in the entire first coupling and the second coupling having a uniform second coupling diameter in the entire second coupling, the first coupling diameter being greater than the second coupling diameter;

a rotor receiving surface between the first coupling and the second coupling;

a shoulder on the mandrel defining a first end of the rotor receiving surface, the shoulder being defined by an increase from a rotor receiving surface diameter to the first coupling diameter; and a collar receiving surface at a second end of the rotor receiving surface, the collar receiving surface providing a surface suitable for a press fit of a collar, the collar receiving surface being longer axially than the collar so that the collar receiving surface extends beyond the collar in an axial direction away from the rotor receiving surface when the collar is seated on the collar receiving surface.

2. The centralizer of claim 1 further comprising a collar press fit on to the collar receiving surface, and a rotor on the rotor receiving surface.

3. The centralizer of claim 2 in which the rotor comprises a tubular sleeve of non-metallic, soft, resilient, abrasion-resistant material.

4. The centralizer of claim 3 in which the rotor comprises polyurethane or high temperature nylon.

5. The centralizer of claim 2 in which the rotor fits loosely upon the rotor receiving surface.

6. The centralizer of claim 2 in which the collar comprises steel.

7. The centralizer of claim 1 in which one or both of the first coupling and the second coupling is or are a box coupling.

8. The centralizer of claim 1 in which the collar receiving surface is smooth.

9. The centralizer of claim 1 in which the collar receiving surface has uniform outer diameter.

10. The centralizer of claim 1 in which the collar receiving surface is unthreaded.

11. The centralizer of claim 1 in which the collar receiving surface has an outer diameter A and the rotor receiving surface has an outer diameter B and A is less than B.

12. The centralizer of claim 11 comprising one of a bevel, taper or rise between the collar receiving surface and the rotor receiving surface.

13. The centralizer of claim 1 in which the mandrel comprises steel.

* * * * *